US010893725B1

(12) United States Patent
Wolf

(10) Patent No.: US 10,893,725 B1
(45) Date of Patent: Jan. 19, 2021

(54) CUSTOMIZABLE WRISTBAND

(71) Applicant: Brandon Wolf, Youngstown, OH (US)

(72) Inventor: Brandon Wolf, Youngstown, OH (US)

( * ) Notice: Subject to any disclaimer, the term of this patent is extended or adjusted under 35 U.S.C. 154(b) by 173 days.

(21) Appl. No.: 16/006,824

(22) Filed: Jun. 12, 2018

Related U.S. Application Data

(60) Provisional application No. 62/519,144, filed on Jun. 13, 2017.

(51) Int. Cl.

| | |
|---|---|
| ***A44C 5/10*** | (2006.01) |
| ***A44C 5/08*** | (2006.01) |
| ***A44C 5/18*** | (2006.01) |
| ***A44C 5/00*** | (2006.01) |

(52) U.S. Cl.
CPC ..... *A44C 5/107* (2013.01); *A44C 5/0069* (2013.01); *A44C 5/08* (2013.01); *A44C 5/185* (2013.01)

(58) Field of Classification Search
CPC ..... A44C 5/0053; A44C 5/0069; A44C 5/08; A44C 5/107; A44C 5/185; A44C 5/2076
See application file for complete search history.

(56) References Cited

U.S. PATENT DOCUMENTS

| | | | | |
|---|---|---|---|---|
| 2,322,461 | A * | 6/1943 | Mariano | A44C 5/00 63/3 |
| 6,880,364 | B1 * | 4/2005 | Vidolin | A44C 5/025 40/633 |
| 8,296,983 | B2 * | 10/2012 | Padgett | A44C 5/0015 40/633 |
| D805,418 | S * | 12/2017 | Lowe | D11/3 |
| D855,488 | S * | 8/2019 | Jablonski | D11/3 |
| 2003/0159463 | A1 * | 8/2003 | Rosenberg | A44C 5/105 63/15.7 |
| 2017/0231338 | A1 * | 8/2017 | Thomas | A44C 17/0216 63/1.12 |

* cited by examiner

*Primary Examiner* — Ryan A Reis
(74) *Attorney, Agent, or Firm* — Harpman & Harpman

(57) ABSTRACT

Rubber silicone bracelets are a popular type of wristband worn today; however, they lack in both customization of content as well as size. The biggest problem with current wristbands is that they are designed for a single cause and are manufactured to represent one specific purpose. The new customizable wristband has a unique design of linking together elastic panels and rigid connectors. It's design allows users to combine links containing different images, words or phrases and connecting those links to form a band. This gives an individual the ability to not only change the look and size of the band but to display the things they are passionate about into a single wristband.

8 Claims, 6 Drawing Sheets

CUSTOMIZABLE WRISTBAND

CROSS-REFERENCE TO RELATED APPLICATIONS

This application is a conversion to a nonprovisional application under 35 U.S.C. § 119(e) from U.S. provisional application No. 62/519,144, entitled "Customizable Wristband", filed on Jun. 13, 2017.

TECHNICAL FIELD

This invention relates to the field of decorative wristband bracelets and more specifically to a customizable wristband with interchangeable flexible graphic panels held together and linked with rigid connectors.

BACKGROUND OF THE INVENTION

Rubber silicone bracelets are a popular type of wristband worn today. The biggest problem with these wristbands is that they are designed for a single cause and are manufactured to represent one specific purpose. Consumers are forced to purchase multiple wristbands or other pieces of jewelry in order to show off the various logos, images or words that represent them. There is little to no autonomy with the current styles, as they offer no variety in what the wristbands stand for or express.

Current wristband designs don't give consumers a chance to display everything they are passionate about or the ability to change the content, look and length of the band all at once. Most "charm" bracelets are also made of precious metals, limiting them to a specific demographic.

BRIEF SUMMARY OF THE INVENTION

This invention allows for users to customize their wristband by connecting multiple graphic panels into a single band. Each piece can represent or stand for something different. In contrast to other designs, it allows for personalized customization with the ability to change both the contents and size of the band.

This wristband design essentially combines multiple bands into one, by giving individuals the opportunity to create a wristband that is exclusive to them with a perfect fit to their wrist. This is accomplished by linking together a chosen number of elastic panels and rigid connectors. It is unique in that all of the parts are linked together without the need for a larger carrying or holding device.

BRIEF DESCRIPTION OF THE SEVERAL VIEWS OF THE DRAWINGS

The drawings include embodiments to the invention, which may be embodied in various forms. It is to be understood that the various aspects of the invention may be shown exaggerated or enlarged for purposes of understanding the invention.

DETAILED DESCRIPTION OF THE INVENTION

It is important to note that all parts of the band are uniquely designed to work together; however, their dimensions and properties are not limiting by the ways in which they can be constructed. Each component can have a different composition as long as they all successfully connect to form a single band. In other words, the relationship by which the components are linked, can be reconfigured or redesigned as long as they accomplish the same goal.

Figure 1:
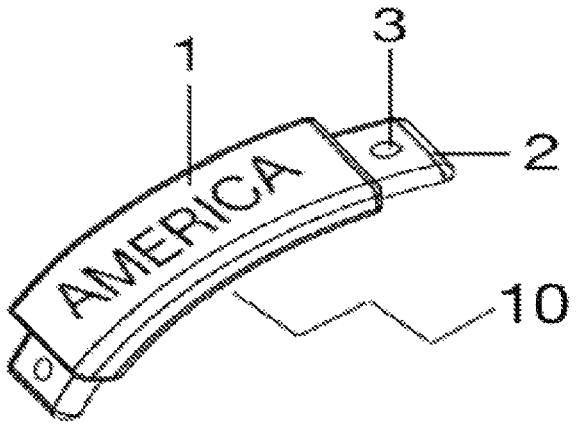
FIG. 1: is a perspective view of a graphic panel of the invention
Figure 2:
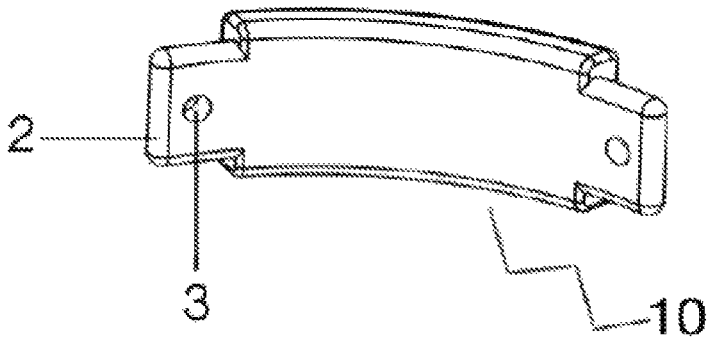
FIG. 2: is a rear view thereof

In referring to FIG. 1 and FIG. 2 of the drawings, a graphic panel (10) can be seen. The graphic panels (10) can be of any size including length, thickness or width. They can also take on multiple durometers, correlating to the hardness of the material which effects the flexibility and feel. The panels (10) can be customized to contain a graphic image (1) which is displayed on it's face as seen in FIG. 1 of the drawings Each panel has two oppositely disposed end tabs (2) of slightly less thickness than the rest of the panel. Each end tab (2) contains a small opening (3) which is where the panels (10) get linked to connectors as will be described in detail herein after.

Figure 3:
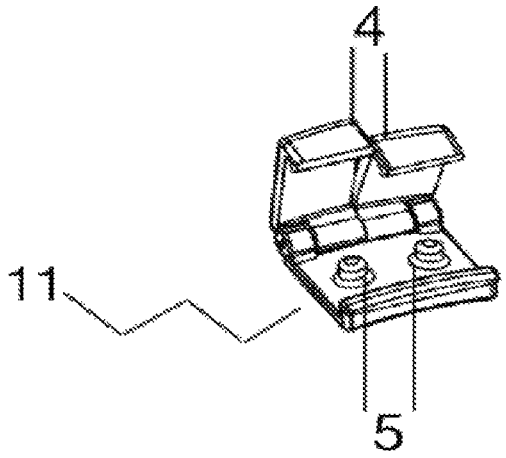
FIG. 3: is a perspective view of a connector in the open position
Figure 4:
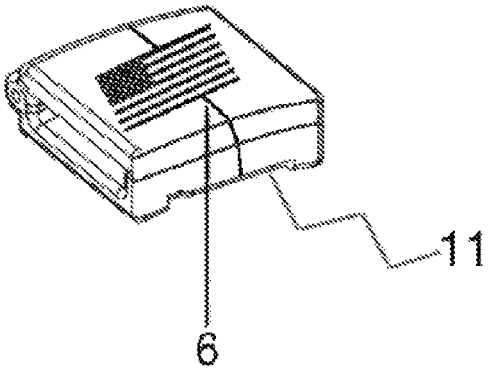
FIG. 4: is a perspective view of a connector in the closed position
Figure 5:
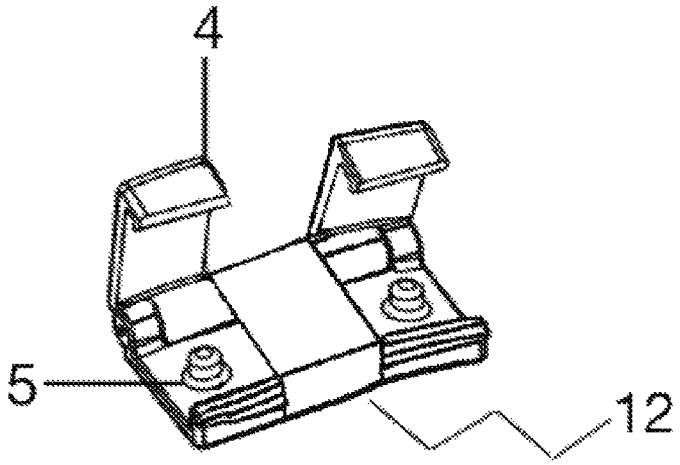
FIG. 5: is a perspective view of an expanded connector

Referring to FIG. 3, 4, 5 of the drawings, a connector (11, 12) can be seen. The connectors can also be made of any size, shape and type of material as well. Different sized connectors (11,12) allow for additional customization with regards to the length of the wristband, which can be seen when comparing connector (11) with connector (12).

A connector (11, 12) can be designed in multiple ways as long as it maintains it's function in connecting the graphic panels (10). Although not required, a dual arm hinged clip design allows for an easy connection between graphic panels, as well as easy removal and placement of the wristband on the wrist. The connectors (11,12) contain two hinged arms (4) for locking in the panels on each side.

There are two small projections (5) on either end of the connector to hold the panels and prevent them from shifting once attached. The hinged locking arms (4) are independent of one another and snap shut to individually lock in a single panel. The face (6) of the connector can also be customized to display a unique graphic.

Figure 6:
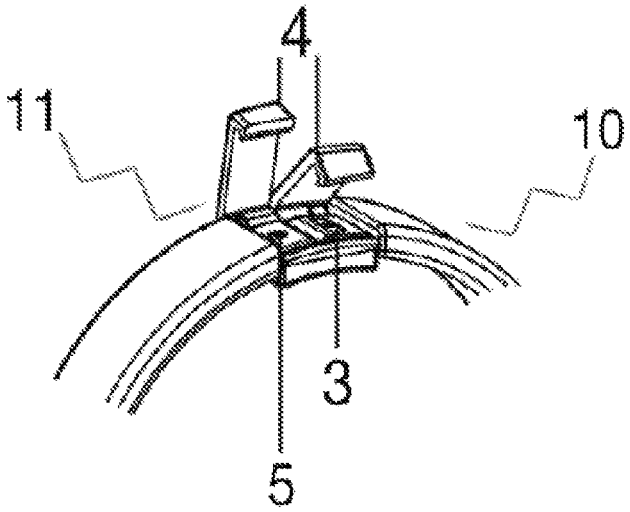
FIG. 6: is a perspective view of a connector and two graphic panels linked together

Referring now to FIG. 6 of the drawings, the connection between a dual arm clip (11) and two graphic panels (10) can be seen. The panels (10) are placed into the connector (11) with the projections (5) of the connector placed into the holes (3) of the panels. Each hinged locking arm (4) is then closed individually and locked to secure it's respective panel into place.

Figure 7:
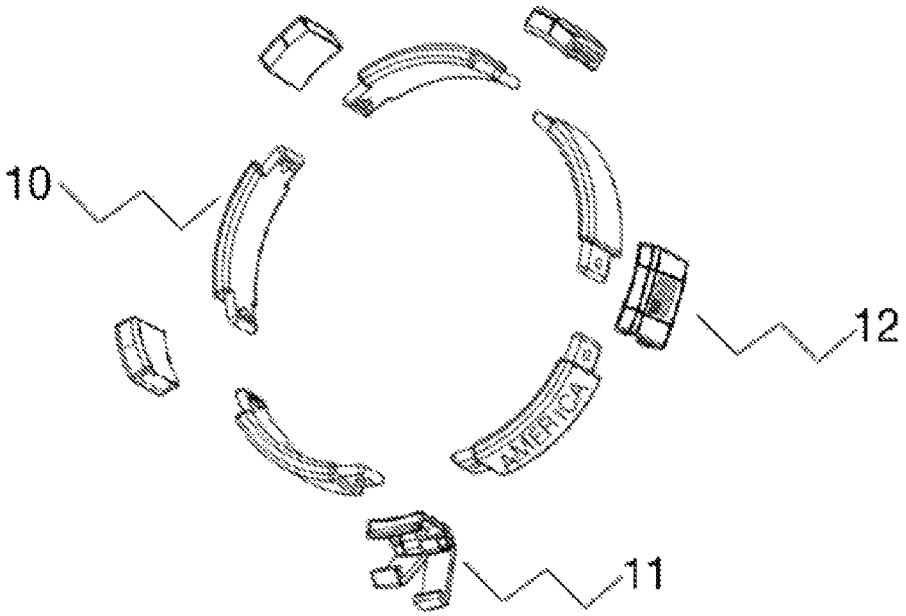
FIG. 7: is an exploded perspective view of the individual components used to create a wristband prior to assembly

In referring to FIG. 7 of the drawings, all the individual components for a wristband prior to assembly can be seen. The band can consist of any component combination, utilizing graphic panels (10) and connectors (11, 12), as long as there is one connector (11, 12) for every graphic panel (10).

Figure 8:
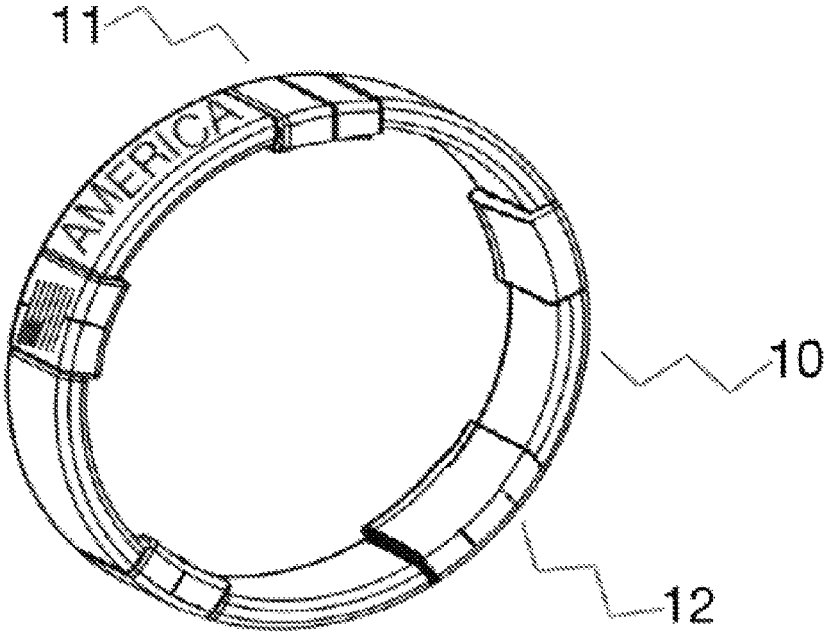
FIG. 8: is a perspective view of a wristband fully assembled with connectors and panels

Referring now to FIG. 8 of the drawings, the wristband fully assembled can be seen. Each graphic panel (10) is attached to a connector (11, 12) and linked together to form one continuous band in a circular fashion. Adding or subtracting components can change the diameter of the band, while each piece can also contain a graphic image to provide additional customization.

The graphic panels (10) may be made of any flexible or semi-flexible material. Various materials may be used to construct the panels (10) such as injection molded silicone, cast urethane or other similar material. Each panel can contain graphics (1) that are embossed, printed or painted on its face. The connectors (11, 12) are made of any plastic like rigid material. Each connector can also contain a graphic (6) that is printed or painted directly to the face or attached via a sticker or decal.

The type and number of connectors used is up to the individual and is another way for users to customize their band. In order to assemble the product, one would first determine the number of units needed to create a wristband that fits their wrist. There will be one connector (11,12) for every panel (10) used.

Once the number and style of all the components is determined, you would then piece together the connectors (11, 12) and graphic panels (10) in an alternating fashion to create one continuous circular band. Panels (10) and connectors (11, 12) are interchangeable and can easily be switched out, added or subtracted from the band.

The invention has been described with several specific embodiments; however, changes can be made to the described invention. It is therefore intended that the above description be read in the illustrative sense and not in the limiting sense. Substitutions and changes can be made while still being within the intended scope of the appended claims.

The invention claimed is:

1. A wristband assembly comprising interchangeable panels, a plurality of connectors selectively interlinking said panels together, said connectors having a pair of longitudinally spaced upstanding projections for registerably engaging end portions of said respective panels, said connectors having a pair of hinged clip arms registerable over said projections securing said panels to said connectors.

2. The wristband assembly set forth in claim 1 wherein said end portions of said panels have oppositely disposed attachment apertures for registration on said connector projections.

3. The wristband assembly set forth in claim 1 wherein said hinge clip arms extend transversely over engaged end panel portions.

4. The wristband assembly set forth in claim 1 wherein said panels have graphics and indicia thereon.

5. The wristband assembly set forth in claim 1 wherein said hinged clip arms are independent of one another.

6. The wristband assembly set forth in claim 1 wherein said panels are of rigid material.

7. The wristband assembly set forth in claim 1 wherein said panels are of resilient flexible, semi-flexible material.

8. The wristband assembly set forth in claim 4 wherein said graphics and indicia comprises: printed indicia, painted indicia, stickers, decals and embossed indicia on said panels.

* * * * *